US006702100B2

(12) United States Patent
Studer

(10) Patent No.: US 6,702,100 B2
(45) Date of Patent: Mar. 9, 2004

(54) DEVICE FOR THE TRANSFER OF SERIALLY SUPPLIED ARTICLES TO A CONVEYING-AWAY SYSTEM

(75) Inventor: Beat Studer, Dürnten (CH)

(73) Assignee: Ferag AG (CH)

( * ) Notice: Subject to any disclaimer, the term of this patent is extended or adjusted under 35 U.S.C. 154(b) by 0 days.

(21) Appl. No.: 10/075,969

(22) Filed: Feb. 14, 2002

(65) Prior Publication Data

US 2002/0125103 A1 Sep. 12, 2002

(30) Foreign Application Priority Data

Feb. 21, 2001 (CH) ..... 0305/01

(51) Int. Cl.[7] ..... B65H 29/68; B65G 25/00; B65G 29/00; B65G 37/00

(52) U.S. Cl. ..... 198/470.1; 271/69; 271/204; 198/448

(58) Field of Search ..... 270/52.09, 52.17; 198/448, 449, 418.9, 803.7, 470.1, 408, 407; 271/69, 204

(56) References Cited

U.S. PATENT DOCUMENTS

| | | | | |
|---|---|---|---|---|
| 3,151,728 A | * | 10/1964 | Schemund | 198/404 |
| 3,590,982 A | * | 7/1971 | Banyas | 198/470.1 |
| 3,693,486 A | * | 9/1972 | Maniaci et al. | 83/88 |
| 3,847,070 A | * | 11/1974 | Draggett | 99/643 |
| 4,039,182 A | | 8/1977 | Reist et al. | |
| 4,201,286 A | * | 5/1980 | Meier | 198/461.3 |
| 4,320,894 A | * | 3/1982 | Reist et al. | 271/277 |
| 4,905,818 A | * | 3/1990 | Houseman | 198/803.7 |
| 5,007,624 A | * | 4/1991 | Chandhoke | 270/58.2 |
| 5,503,264 A | | 4/1996 | Eberle | |
| 5,660,382 A | | 8/1997 | Meier | |
| 6,213,459 B1 | * | 4/2001 | Cote et al. | 271/85 |
| 6,213,461 B1 | * | 4/2001 | Ratz et al. | 271/187 |
| 6,254,088 B1 | * | 7/2001 | Kramer et al. | 271/204 |

FOREIGN PATENT DOCUMENTS

| | | |
|---|---|---|
| DE | 199 27 919 A1 | 1/2000 |
| EP | 0 990 535 A1 | 4/2000 |
| EP | 1 044 907 A2 | 10/2000 |

* cited by examiner

*Primary Examiner*—Richard Ridley
(74) *Attorney, Agent, or Firm*—Oppedahl & Larson LLP

(57) ABSTRACT

Flat articles are taken over from a supply device supplying the products e.g. in the form of an imbricated stream and, for creating groups, are transferred to a conveying-away device. Thereby the supply direction and the conveying-away direction are angled in the horizontal plan view. For the transfer of the articles devices are used having a circulating conveying organ with laterally protruding gripper arms and grippers arranged on the gripper arms. The circulation track of the conveying organ extends in a take-over direction through a take-over zone and in a transfer direction through a transfer zone and represents a deflection between take-over and transfer zone.

13 Claims, 5 Drawing Sheets

DEVICE FOR THE TRANSFER OF SERIALLY SUPPLIED ARTICLES TO A CONVEYING-AWAY SYSTEM

The invention is situated in the field of materials handling technology and is related to a device serving for the transfer of flat articles being supplied one after the other (serially) to a conveying-away system, wherein the device takes over the articles from a supply device, conveys them onwards in a take-over direction and during conveyance in a transfer direction transfers them to the conveying-away system.

STATE OF THE ART

Devices of the type mentioned are used, for example, for gathering printed products into product groups to be further processed as units. For such gathering, various types of printed products are supplied to a feed point each, for example from stacks by means of feeders, from rolls by means of winding stations and/or continuously in the form of streams of imbricated products. The product groups to be formed by gathering are conveyed one after the other past a plurality of feed points, wherein at each feed point one printed product is added to each one of the product groups being conveyed past, for example from above or from below. If the product groups being such created are conveyed continuously, a problem-free transfer at every feed point is possible only if the products are conveyed in substantially the same direction as the product groups being produced, at least immediately preceding the effective transfer. Thereby the conveying direction of the products to be added to the groups approaches the direction of group conveyance e.g. from above or from below.

An installation as briefly described above serving for gathering printed products comprises a plurality of supply devices (e.g., feeders, winding stations, devices for conveying imbricated product streams, etc.), a device for conveying product groups being created and for each feed point one transfer device taking over the products from the supply device and transferring them to the product groups being created. The transfer devices can also be integrated in the supply devices or in the device for conveying the product groups.

Such installations should fulfil the most varied requirements, for example:

- the installation should be as simple as possible (conveying movements being as simple as possible and continuous);
- the installation should allow conveyance in as dense as possible conveying streams both for the products to be supplied and the groups being created (conveying speeds as low as possible);
- the installation should require as little space as possible and should have as short as possible transfer paths between the supply devices and the feed points (supply devices located as close as possible together and as close as possible to the feed points);
- the installation should allow transfer of the products without significant change of their orientation relative to the conveying direction.

These requirements are fulfilled by known installations in different ways and to a greater or lesser degree.

In installations with a drum-shaped conveying device, in which product groups being created are conveyed continuously in radial direction and stepwise in axial direction, it is easily possible to have dense conveying streams, equal product orientations for product supply and group conveyance as well as a space-saving arrangement of supply devices and short transfer paths between supply device and feed point (transfer paths extending in one plane only). The drum-shaped conveying device, however, is a rather complicated device as such. About the same is valid for installations with linear conveying devices, in which straight line, continuous group conveyance in a main conveying direction is superimposed by a further, stepwise conveyance transverse to the main conveying direction.

Installations, in which group conveyance is continuous and forms an essentially straight line, also render dense conveying streams possible. A space-saving arrangement of the supply devices along a conveying route of this type, however, makes it necessary, that the transfer paths extend in a three-dimensional manner (transfer paths with an angled plan view layout or with additional lateral displacement). Known devices for conveying the products to be transferred along three-dimensional transfer paths are, for example, twisted pairs of conveyor belts or other conveying devices suitable for a twisted arrangement. Devices of this type are rather elaborate and because of the relatively large bend radii necessary, result in rather long transfer paths. Furthermore, twists by less than 360° change the orientation of the products to be transferred relative to the direction of conveyance.

BRIEF DESCRIPTION OF THE INVENTION

The invention attempts to combine the advantages of the two types of installations as mentioned above, i.e. it attempts to combine a substantially straight-line, continuous conveyance of a dense stream of product groups being created during conveyance past feed points with a space-saving arrangement of supply devices and short, easily implementable transfer paths between supply devices and feed points.

It is therefore, the object of the invention to create a device for transferring flat articles being supplied serially (e.g., printed products to be added to product groups) to a continuous conveying-away system (e.g., conveyance of product groups being created). With this device, the articles are to be taken over from an as such known supply device (e.g., sheet feeder, winding station, continuous feeder), conveyed along a transfer path and from above or from below transferred to an as such known, continuously operating conveying-away device, which defines a conveying-away direction, wherein the transfer path and the conveying-away path represent an angled, three-dimensional path construction. Thereby the transfer path is to be significantly shorter than known three-dimensional transfer path arrangements. The transfer device in accordance with the invention nonetheless is to be simple and it shall make it possible to take over the articles with an orientation relative to the conveying direction and to transfer them with the same orientation relative to the conveying direction.

The device according to the invention comprises a circulating conveying organ and grippers conveyable with the help of the conveying organ, each gripper serving for gripping an edge zone of one flat article. The part of the circulation track of the conveying organ used for conveyance comprises a take-over zone (conveyance in takeover direction) and a transfer zone (conveyance in transfer direction) following the take-over zone after a deflection. The take-over direction and the transfer direction intersect and define a plane of conveyance. For deflecting the conveying organ between take-over zone and transfer zone there is e.g. provided a deflection means rotating around an axis oriented vertically to the plane of conveyance and possibly serving also as a drive means.

The circulation track of the conveying organ is arranged relative to the conveying-away direction of the conveying-away device in the following manner: A transfer plane contains the transfer direction and the conveying-away direction or a parallel thereto, wherein the transfer direction and the conveying-away direction or parallels thereto run towards each other at an acute angle and intersect. The transfer plane stands vertically on a base plane. The take-over direction intersects the transfer plane. There is a take-over plane containing the take-over direction, standing vertical to the base plane and enclosing an angle (e.g., a right angle) with the transfer plane, wherein the transfer direction and the take-over direction intersect in the angle-point of this angle. Transfer direction and take-over direction have different inclinations relative to the base plane (e.g., gradients opposing one another), at least the gradient of the transfer direction being also different from the gradient of the conveying-away direction. This signifies, that the plane of conveyance defined by the transfer direction and the take-over direction is intersected obliquely by the conveying-away direction.

The direction in which the articles are supplied (supply direction) or a parallel thereto extends in preference and dependent on the transfer mode in the take-over plane.

The grippers are arranged on gripper arms laterally protruding from the conveying organ, wherein the gripper arms are oriented vertically to the longitudinal expanse of the conveying organ, therefore vertically to the take-over and transfer direction, and at least locally they extend non-parallel to the plane of conveyance defined by the take-over and transfer direction. The angle between the gripper arms and the plane of conveyance is dependent on the gripper arm orientation relative to the take-over and transfer plane, on the gradients of take-over and transfer direction and on the angle between take-over and transfer plane. The gripper arm orientations relative to take-over and transfer plane is predetermined by the take-over and/or the transfer mode and is e.g. perpendicular, i.e. parallel to the base plane.

If the gripper arm orientations necessary for take-over and transfer are equal and the gradients of the take-over and the transfer directions are opposing and equal, then the angle between the plane of conveyance and the gripper arms is the same for take-over and transfer, i.e., it can be maintained constant over the whole circulation track of the conveying organ. This is applicable for the preferred embodiment of the device according to the invention, in which the gripper arms are arranged in a fixed manner on the conveying organ and the conveying organ does not have to be able to be twisted.

The one part of the circulation track of the conveying organ, which does not serve as active conveying part, can be designed in any way required both with respect to its course as well as with respect to the gripper arm orientation. The device becomes particularly simple, if this inactive part of the circular path extends in the plane of conveyance defined by the take-over direction and the transfer direction and comprises two further deflection means such that the circulation track of the conveying organ substantially represents a flat triangle.

The conveying organ of the device in accordance with the invention is e.g. an endlessly circulating conveyor chain with gripper arms fixedly arranged on its links. If the angle between the plane of conveyance and the gripper arms is to be different for take-over and transfer and therefore has to be adjustable, then the chain links have to be designed to be able to be rotated relative to one another around the conveying direction (twistable chain) and the chain has to be guided within a channel with a slot, wherein the gripper arms protrude from the slot and the position of the slot relative to the direction of conveyance defines the local angle between the gripper arms and the conveying direction. Also conceivable are gripper arms arranged to be capable of being articulated on the chain links of a non-twistable chain, and being controlled by corresponding cam members in a manner to form locally predefined angles with the plane of conveyance.

Instead of a chain conveyor, it is possible to provide a multitude of conveyor elements, which are more or less independent of one another, which carry gripper arms and which are driven in a suitable guide means, for example, by e.g. pushing one another along. Such conveying elements can be designed to either be capable of being rotated around the direction of conveyance or not.

The device according to the invention is applicable in particular for transferring serially supplied flat articles to a device, with the help of which article groups being created by successive article transfer to each group are continuously conveyed one behind the other, wherein in a plane view, the supply direction is e.g. perpendicular to the direction of group conveyance. Thereby it is possible for the planes of conveyance of adjacent transfer devices to overlap one another, so that a really tight arrangement along the group conveying device becomes possible. In the same manner, the device in accordance with the invention can be used wherever flat articles are serially supplied and have to be transferred to a continuous conveying-away system extending at an angle to the supply direction.

BRIEF DESCRIPTION OF THE FIGURES

The device according to the invention and exemplary embodiments of it are described in more detail on the basis of the following Figs. wherein.

DETAILED DESCRIPTION OF THE INVENTION

Figure 1:
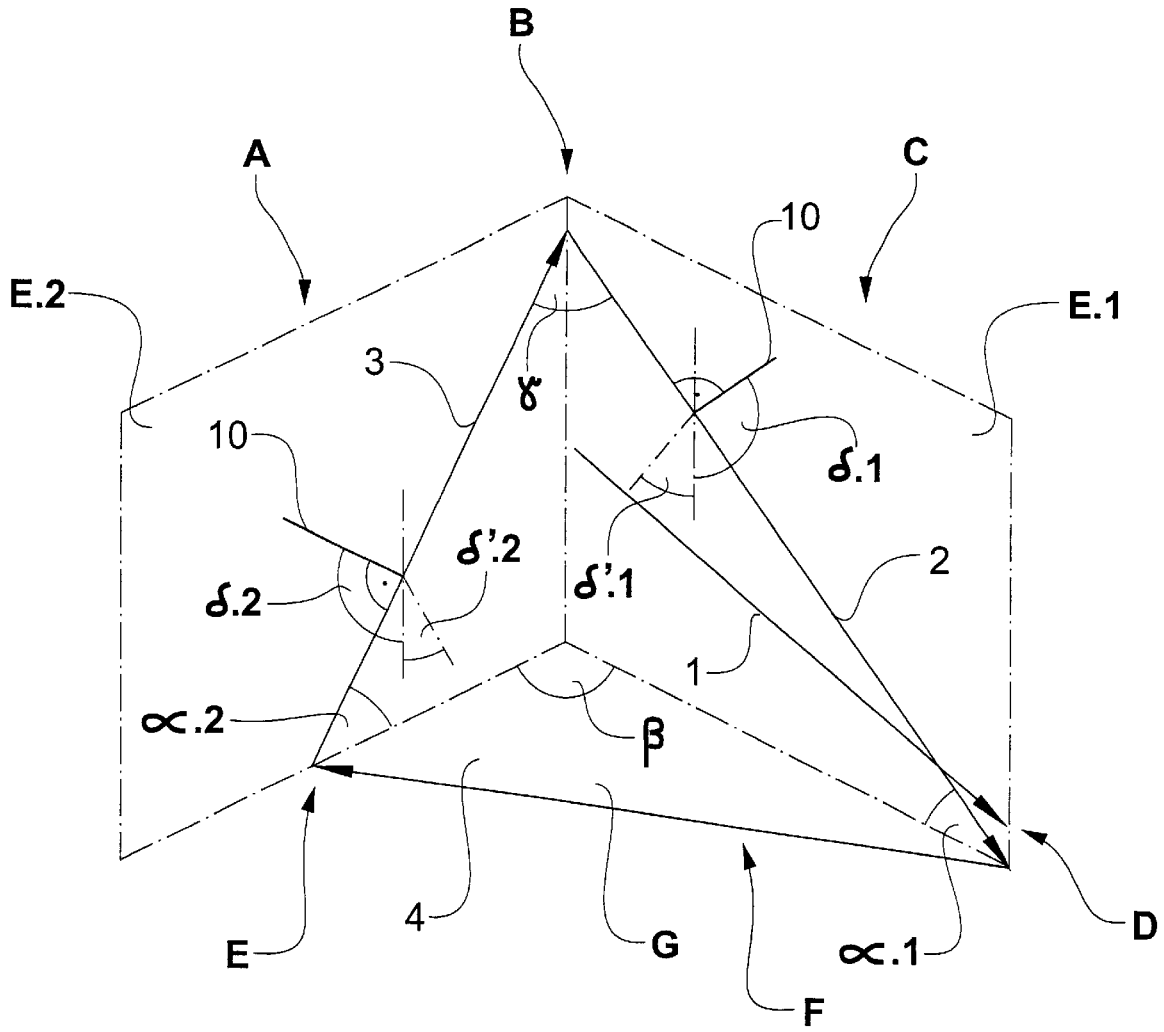
FIG. 1 is a schematic sketch of the principle of the device in accordance with the invention and serves for introducing the expressions used in the present specification.

FIG. 1 is a three-dimensional schematic sketch of the geometric principle of the device and it serves for introducing the terms used in the following description. FIG. 1 illustrates the most general embodiment of the device in accordance with the invention.

Depicted are three planes: a transfer plane E.1, in which the conveying-away direction 1 or a parallel thereto and the transfer direction 2 approach one another or intersect, a base plane G, on which the transfer plane E.1 stands vertically, and a take-over plane E.2 standing also vertically on the base plane G, forming an angle β with the transfer plane E.1, the take-over direction 3 and if so required a supply direction (not shown) extending in the take-over plane E2. The transfer direction 2 has a gradient angle α.1 relative to the base plane G, the take-over direction 3 a gradient angle α.2. The transfer direction 2 and the take-over direction 3 intersect on the intersection line of the planes E.1 and E.2, define the plane of conveyance 4 and encompass the deflection angle γ, the projection of which on the base plane G (horizontal plan) is the angle β.

The conveying organ, which substantially extends along the take-over direction 3 and along the transfer direction 2, is moved for taking-over the flat articles (not illustrated) in the take-over direction 3 (take-over zone A), is deflected by the angle γ (deflection zone B) and is moved in the transfer direction 2 against the conveying-away direction 1 (transfer zone C), wherein during the latter movement the articles are transferred. The remainder of the circulation track of the conveying organ can be designed in any manner required. For example, the circulation track shown by FIG. 1 comprises two further deflections D and E and a part F extending in the base plane G.

The gripper arms 10, one of which is illustrated in the transfer zone C and one in the take-over zone A, form a right angle with the transfer direction 2 or the take-over direction 3 respectively and with the planes E.1 or E.2 respectively they form a predetermined transfer angle δ.1 or take-over angle δ.2 respectively. The angles relevant for the design of the device are the angles between the gripper arms 10 and the plane of conveyance 4. These angles are determined by the transfer and take-over angles δ.1 and δ.2 and the corresponding local inclination of the plane of conveyance 4 relative to the planes E.1 and E.2 (angles δ'.1 and δ'.2).

In the most general case the device according to the invention serves for transferring serially supplied, flat articles to a continuous conveying-away system with a conveying-away direction 1, wherein, the articles are taken-over in a take-over zone A, are conveyed in the take-over zone in a take-over direction 3 and then in a transfer zone C in a transfer direction 2 and are in the transfer zone transferred to the conveying-away system. The transfer direction 2 and the conveying-away direction 1 or a direction parallel thereto approach one another or intersect in the transfer plane E.1 and the take-over direction 3 intersects the transfer direction 2 and the transfer plane E.1. For this purpose, the device comprises a conveying organ circulating on a circulation track and a plurality of gripper arms 10 being arranged to be laterally protruding from the conveying organ, wherein the circulation track comprises a take-over zone A oriented in the take-over direction 3, a transfer zone C oriented in the transfer direction 2 and between the take-over zone A and the transfer zone C a deflection B, and wherein the gripper arms 10 are arranged on the conveying organ perpendicular to the longitudinal extension of the conveying organ and at least in the take-over and transfer zone not being parallel to the plane of conveyance 4 formed by the take-over direction 3 and the transfer direction 2. The local angle δ+δ' between the plane of conveyance 4 and the gripper arms 10 is dependent on the gradients of the take-over direction 3 and of the transfer direction 2 relative to the base plane G and on the spatial orientations of the gripper arms 10 being predefined by the transfer and take-over mode.

Figure 2:
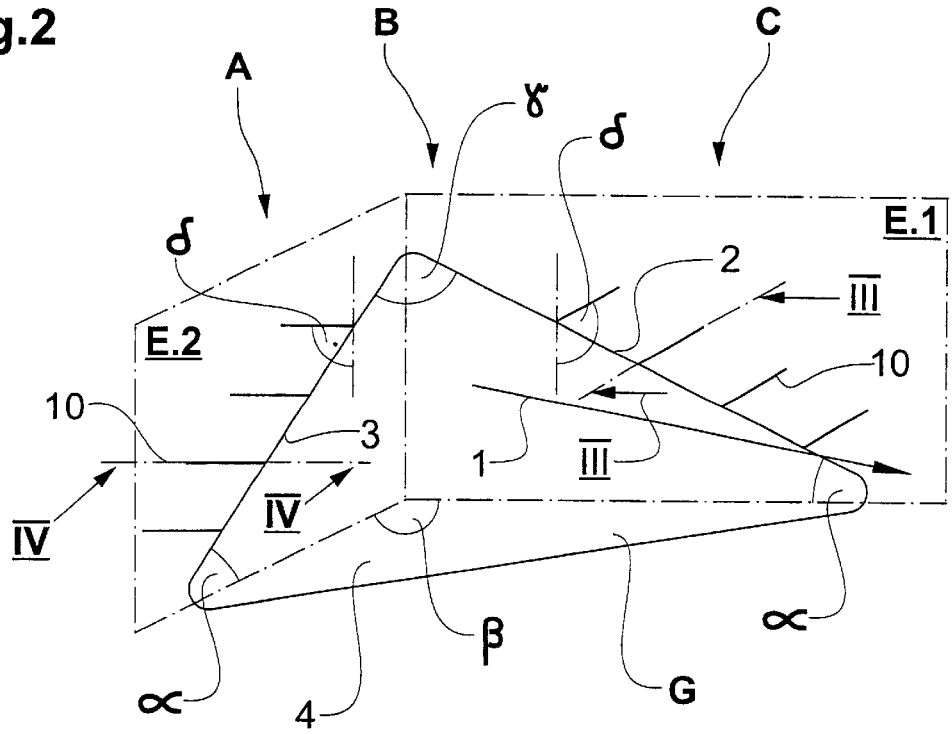
FIG. 2 is a schematic, three-dimensional illustration of a preferred embodiment of the device according to the invention.

FIG. 2 shows in a very similar way as FIG. 1 a preferred embodiment of the device in accordance with the invention. The same parts are indicated with the same reference marks as in FIG. 1.

For the embodiment according to FIG. 2, the gradients of the transfer direction 2 and of the take-over direction 3 are equal and opposing (gradient angle α). For take-over as well as for transfer, the gripper arms 10 are oriented parallel to the base plane G, therefore they form right angles with planes E.1 and E.2 (take-over angle=transfer angle=δ=90°). For reasons of symmetry, in this embodiment the inclination of the plane of conveyance 4 relative to the planes E.1 and E.2 is equal (angle δ'), and therefore the angles between the plane of conveyance 4 and the gripper arms 10 in the relevant zones of the circulation track of the conveying organ are also equal. Therefore, it is possible for the gripper arms 10 to be installed fixedly on a non-twistable conveying organ, which makes the device particularly simple.

Figure 3:
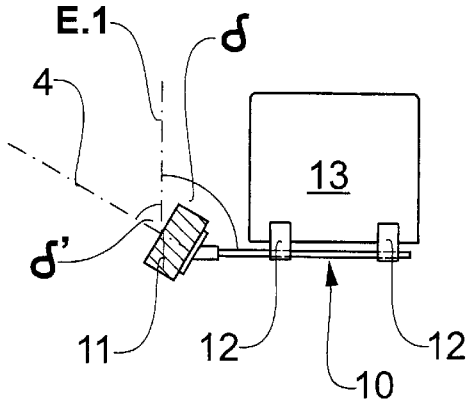
FIGS. 3 and 4 are schematic cross sections through a conveying organ with gripper arms for a device according to the invention as illustrated by FIG. 2, shown in the transfer zone (FIG. 3) and in the take-over zone (FIG. 4)
Figure 4:
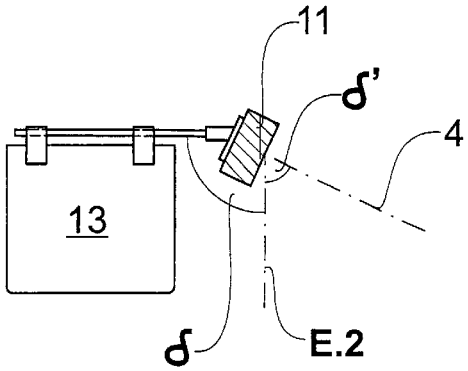

FIGS. 3 and 4 illustrate cross-sections through the conveying organ 11 of the embodiment of the device in accordance with the invention as illustrated in FIG. 2, in the transfer zone (FIG. 3, section line III—III in FIG. 2) and in the take-over zone (FIG. 4, section line IV—IV in FIG. 2). These Figs. clearly manifest the equal inclination of the plane of conveyance 4 for the transfer zone C and for the take-over zone A (angle δ') and the same orientation of the gripper arms (angle δ, for example, 90°), which results in equal angles (δ+δ') between the plane of conveyance 4 and the gripper arms 10.

It will be shown later on in connection with FIGS. 8 and 9, that with an angle β=90° the deflection angle γ and the angle δ' describing the inclination of the plane of conveyance 4 are dependent on the inclination angle α through simple functions.

FIGS. 3 and 4 show gripper arms 10 with a pair of two grippers 12 each, wherein each gripper pair conveys one flat article 13, for example, suspended and gripped by its upper edge, and wherein this upper edge is oriented parallel to the gripper arm 10 and therefore both during take-over and transfer is oriented parallel to the base plane G, for example, horizontally.

Figure 5:
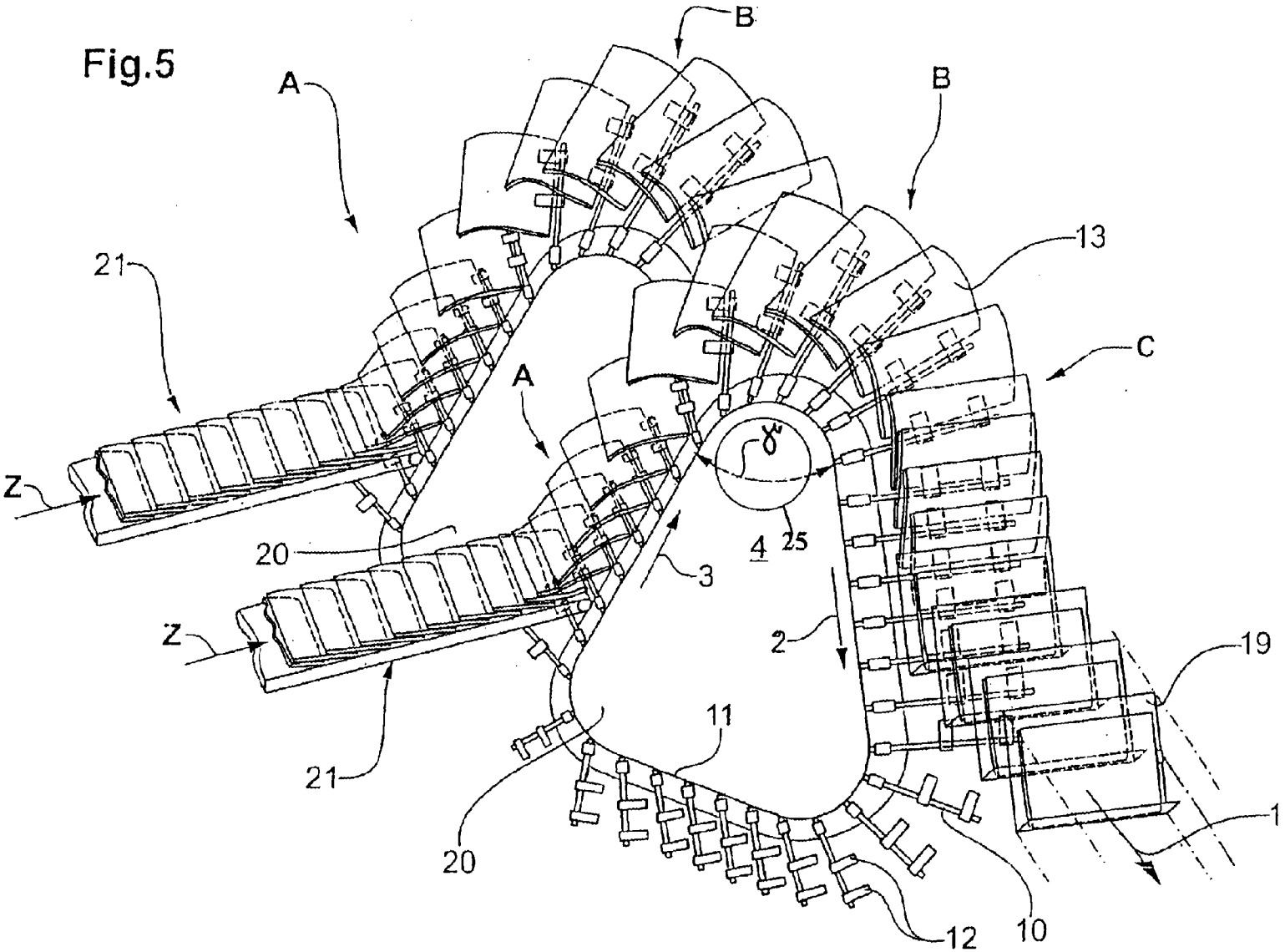
FIGS. 5 to 7 show an installation for producing groups of printed products and comprising two devices according to the invention as shown by FIG. 2, illustrated three-dimensionally (FIG. 5), in a side view parallel to the conveying-away direction (FIG. 6) and from a bird's eye view (FIG. 7)

FIG. 5 is a three-dimensional illustration of an installation for continuously conveying L-shaped supports 19 in the conveying-away direction 1 past a plurality of feed points. At each one of the feed points, a printed product or another flat article 13 is deposited on each one of the L-shaped supports being conveyed past it, so that on the L-shaped supports groups of flat articles are created and are conveyed away. The supply devices (not illustrated in full) are arranged in such a manner, that they supply the flat articles in a supply direction Z substantially perpendicular to the conveying-away direction 1.

FIG. 5 illustrates two feed points, each of which being equipped with an embodiment of the transfer device 20 as schematically shown in FIG. 2, wherein the transfer devices are arranged so close together, that they overlap one another along the conveying-away direction 1.

Each one of the transfer devices 20 comprises an endless circulating conveying organ 11 with gripper arms 10 and pairs of grippers 12 arranged thereon, wherein the circulation track of the conveying organ 11 encompasses an inclined, substantially triangular plane of conveyance 4, from which the gripper arms 10 all protrude with the same angle.

The flat articles 13 are supplied by the supply device (feeder, winding station, etc., not shown), for example, in the form of imbricated streams 21 with horizontally aligned leading edges situated on the bottom side of the stream and in the take-over zone A they are each gripped at their leading edges by a pair of grippers 12. The articles 13 are then conveyed upwards in the take-over direction 3 (in the same vertical plane as the supply direction Z) and are deflected downwards in the deflection zone B by the angle γ. They are then conveyed in transfer direction 2 through the transfer zone C to be transferred to the L-shaped supports 19. For the transfer the grippers are opened and the products are deposited on the L-shaped supports 19, wherein the gripper arms 10 and the L-shaped supports 19 pass through one another in a comb-like manner.

A transfer with means of conveyance passing through one another in the manner of a comb is described in the Swiss patent application 2525/00 of the same applicant.

The same as in the take-over zone A, also in the transfer zone C and on being conveyed away, the flat articles 13 form a dense conveying stream, in which they overlap one another and in which the leading edges are horizontally aligned and arranged to be on the lower side of the stream.

It is also possible to provide a chain of V-shaped compartments in place of the L-shaped supports illustrated in FIG. 5, and to introduce the flat articles into the compartments held by the grippers and then drop them. For a transfer of this type, the articles 13 have to be supplied in an imbricated stream with their leading edges on the upper side of the stream and they have to be transferred either obliquely or vertically suspended. Furthermore, after being opened, the grippers have to be swivelled into a position (e.g., vertically upwards), in which they are capable of being conveyed past the V-shaped compartments.

Figure 6:
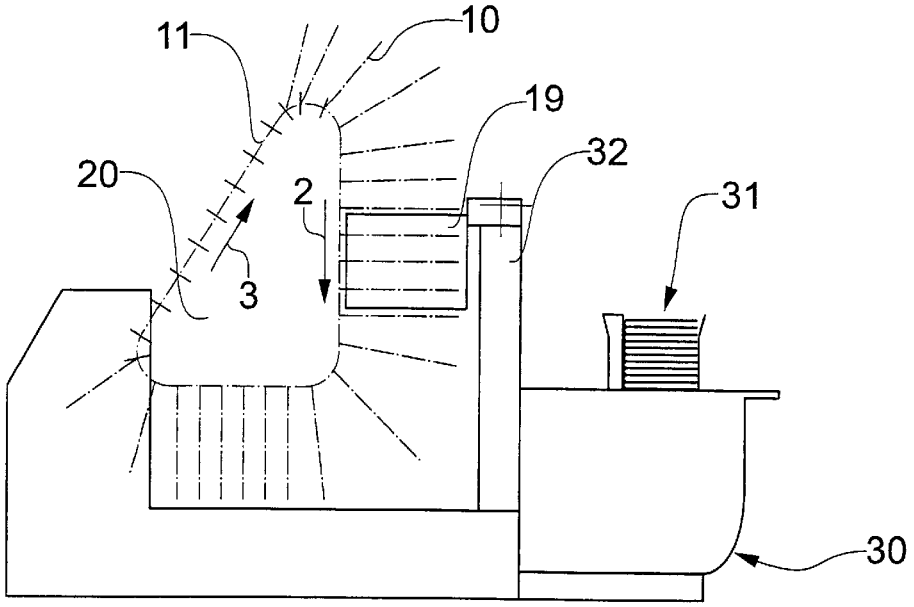
Figure 7:
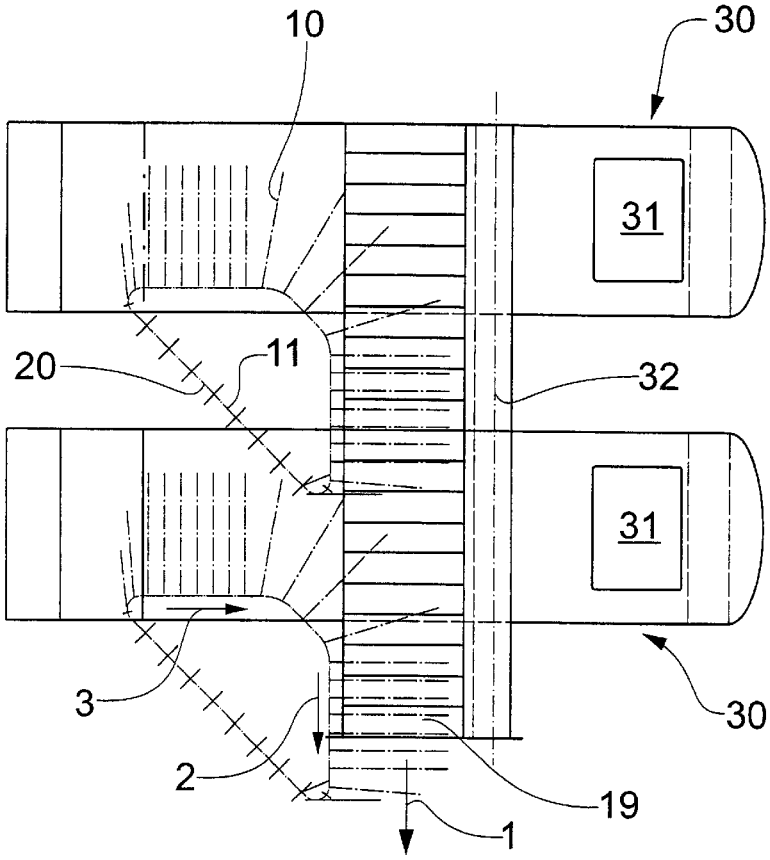

FIGS. 6 and 7 show the installation depicted three-dimensionally in FIG. 5 as a side view (viewing direction parallel to the conveying-away direction 1, FIG. 6) and from a bird's eye view (FIG. 7). Also illustrated in these Figs. are feeders 30 operating as supply devices de-collating the printed products from the bottom side of a stack 31 and conveying them underneath the conveying-away device (L-shaped supports 19 fixed laterally to a conveying organ 32) in an imbricated stream. On the other side of the conveying-away device, the printed products are then taken-over by the devices in accordance with the invention 20 and are transferred to the L-shaped supports. On both FIGS. 6 and 7, the mutual "combing through" of gripper arms 10 and supports 19 is in evidence.

Figure 8:
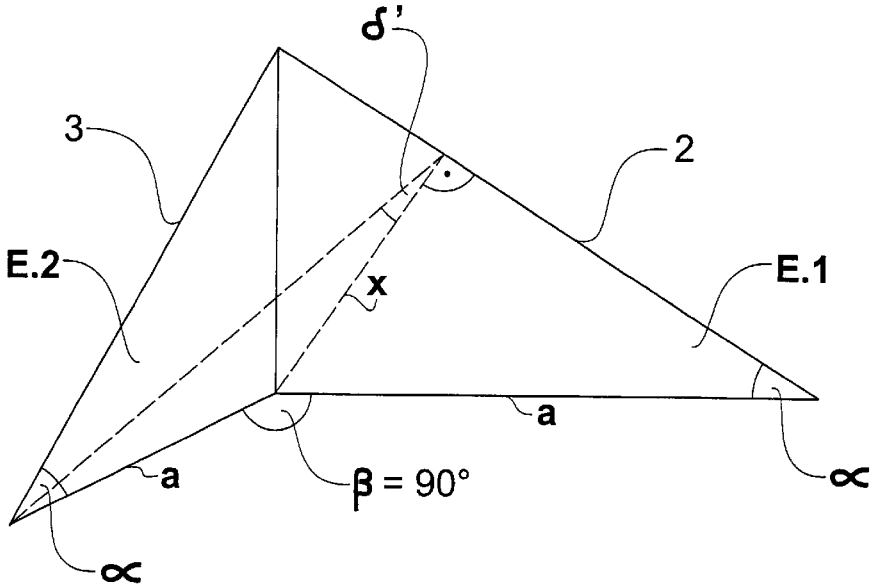
FIGS. 8 and 9 are two schematic, three-dimensional illustrations as per FIG. 2 for illustrating the relationships between relevant angles in a device in accordance with the invention as per FIGS. 2 and 5 to 7.

FIG. 8 shows a device according to the invention and as illustrated in FIGS. 2 and 5 to 7 having an angle β=90°. This figure serves for illustrating the dependence of the inclination of the plane of conveyance relative to the take-over and transfer plane E.2 and E.1 (defined by the angle δ') on the angle α. Resulting from this FIG. is, that tgδ'=a/x and sinα=x/a. From this follows:

$$tg\delta'=1/\sin\alpha$$

This signifies, that with a change of α between 0° and 90°, δ' changes from 90° to 45° (α=30°, δ'=64°; α=45°, δ'=55°; α=60°, δ'=49°).

Figure 9:
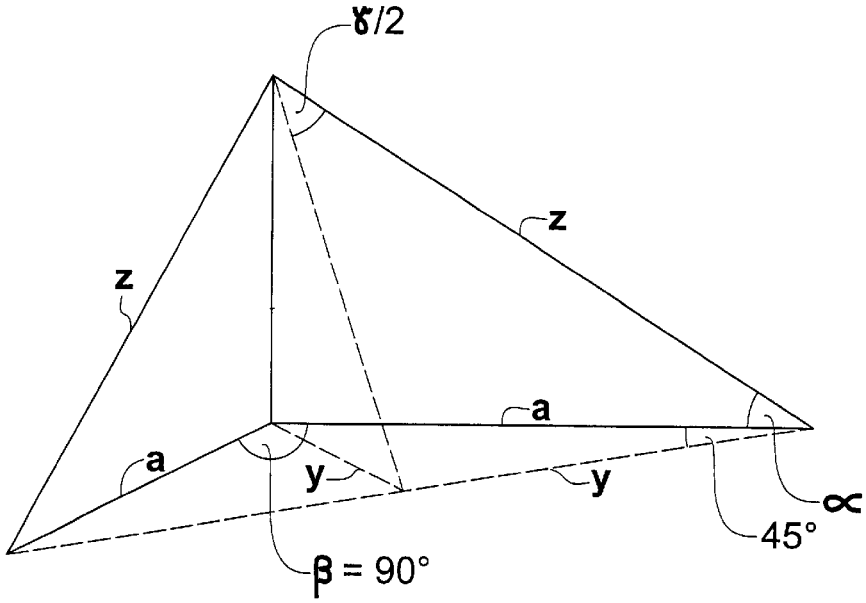

FIG. 9 shows a device in accordance with the invention and as illustrated in FIGS. 2 and 5 to 7 and comprising an angle β=90°. This FIG. shows the dependence of the deflection angle γ on the gradient angle α. Resulting from this FIG. is, that sin γ/2=y/z, wherein $2y^2=a^2$ and z=a/cos α. From this follows:

$$\sin\gamma/2=2^{-1/2}\cos\alpha$$

This signifies, that with a change of α between 0° and 90°, γ changes from 90° to 0° (α=30°, γ=76°, α=45°, γ=60°, α=60°, γ=41°).

What is claimed is:

1. A device for taking over flat articles (13) being serially supplied by a supply system, conveying them in a take-over direction (3) and then in a transfer direction (2) to be transferred to a conveying-away system and to be conveyed away in a conveying-away direction (1), wherein the transfer direction (2) and the conveying-away direction (1) or a parallel thereof approach one another or intersect in a transfer plane (E.1) standing vertically on a base plane (G) and the take-over direction (3) intersects the transfer direction (2) and the transfer plane (E.1), the device comprising a conveying organ (11) circulating on a circulation track and a plurality of gripper arms (10) each carrying at least one gripper (12) arranged to protrude on the conveying organ (11), wherein the circulation track comprises a take-over zone (A) oriented in the take-over direction (3), a transfer zone (C) oriented in the transfer direction (2) and between the take-over zone (A) and the transfer zone (C) a deflection (B), and wherein the gripper arms (10) are oriented perpendicularly to the expanse of the conveying organ (11) in its direction of travel and at least in the take-over and/or transfer zone (A and C) are non-parallel to a plane of conveyance (4) defined by the take-over direction (3) and the transfer direction (2).

2. The device of claim 1, wherein the complete circulation track of the conveying organ (11) extends in the plane of conveyance (4) and in addition to the deflection (B) comprises two further deflections (D and E) between the transfer zone (C) and the take-over zone (A).

3. The device of claim 2, wherein a part of the circulation track of the conveying organ extends in the base plane (G) between the further deflections (D and E).

4. The device of claim 1, wherein gradients of the take-over direction (3) and of the transfer direction (2) relative to the base plane (G) are of opposite and equal value and that an angle (δ+δ') between the plane of conveyance (4) and the gripper arms (10) is constant along the whole circulation track of the conveying organ (11).

5. The device of claim 4, wherein the gripper arms (10) have a second orientation relative to the plane of conveyance (4), into which they are capable of being swivelled immediately following transfer of the articles (13).

6. The device of claim 4, wherein the gripper arms (10) are aligned parallel to the base plane (G) in the take-over zone (A) and in the transfer zone (C).

7. The device of claim 1, wherein an angle (β) between the transfer plane (E.1) and a projection of the take-over direction (3) onto the base plane (G) is a right angle.

8. The device of claim 1, wherein the circulating conveying organ (11) comprises a chain conveyor or a multitude of conveying elements independent of one another and that the gripper arms (10) are arranged on chain links of the chain or on the conveying elements.

9. The device of claim 8, wherein for the deflection (B) of the conveying organ (11) between the take-over zone (A) and the transfer zone (C) a chain wheel is provided.

10. The device of claim 1, wherein there are two grippers arranged on every gripper arm (10), the two grippers being distanced from each other.

11. The device of claim 1, wherein the approach or intersection of the transfer direction and the conveying-away direction define a feed point, the conveying-away system comprising a plurality of continuously conveyed L-shaped supports, the L-shaped supports carrying at least one printed product, wherein at the feed point one additional printed product is deposited on each L-shaped support to form groups of printed products on the L-shaped supports.

12. A method performed with respect to flat articles being serially supplied by a supply system, and being conveyed away in a conveying-away system, the method comprising the steps of:

operating a conveying organ circulating on a circulation track and comprising a plurality of gripper arms each carrying at least one gripper, the gripper arms arranged to protrude on the conveying organ, the circulation track comprising a take-over zone oriented in a take-over direction and a transfer zone oriented in a transfer direction, wherein the gripper arms are oriented perpendicularly to the expanse of the conveying organ in its direction of travel and at least in the take-over or transfer zone are non-parallel to a plane of conveyance defined by the take-over direction and the transfer direction;

by means of the conveying organ, conveying the flat articles in a take-over direction and then in a transfer direction to be transferred to the conveying-away system; and conveying the flat articles away in a conveying-away direction, wherein the transfer direction and the conveying-away direction or a parallel thereof approach one another or intersect in a transfer plane standing vertically on a base plane and the take-over direction intersects the transfer direction and the transfer plane.

13. The method of claim 12, wherein the approach or intersection of the transfer direction and the conveying-away direction define a feed point, wherein a plurality of L-shaped supports are continuously conveyed, and wherein at each feed point a printed product is deposited on each L-shaped support to form groups of printed products on the L-shaped supports.

* * * * *